United States Patent [19]

Arregui et al.

[11] Patent Number: 4,645,428

[45] Date of Patent: Feb. 24, 1987

[54] RADIAL PISTON PUMP

[76] Inventors: Manuel Arregui, P.O. Box 495, Prince Albert, Canada, S6V 5R8; Rafael Diaz, Benito Guinea, 12-6°D, Vitoria-Alada, Spain; Vicente Gamon, Avda Iparralde No. 25-1°, Irun (Guipuzcoa), Spain; Javier Yarza, 4-3°, Irun S.S., Spain

[21] Appl. No.: 793,533

[22] Filed: Oct. 31, 1985

[51] Int. Cl.[4] ..... F04B 27/04

[52] U.S. Cl. ..... 417/273

[58] Field of Search ..... 91/495; 417/203, 273

[56] References Cited

U.S. PATENT DOCUMENTS

| | | | |
|---|---|---|---|
| 949,714 | 2/1910 | Peck | 417/273 |
| 1,724,084 | 8/1929 | Guinard | 417/273 |
| 2,106,488 | 1/1938 | McCune | 417/203 |
| 2,136,339 | 11/1938 | Halleck | 417/203 |
| 2,453,266 | 11/1948 | Rockwell | 417/203 |
| 3,093,301 | 6/1963 | Mitchell | 417/273 |
| 3,863,548 | 2/1975 | Vachon | 91/495 |

FOREIGN PATENT DOCUMENTS

| | | | |
|---|---|---|---|
| 546210 | 9/1957 | Canada | 91/493 |

*Primary Examiner*—Carlton R. Croyle
*Assistant Examiner*—Paul F. Neils

[57] ABSTRACT

A fluid displacement rotary machine is disclosed, more specifically a rotating piston compressor enclosed in a casing formed with a vent through which may freely enter the gas or vapor to be compressed. Radial cylinders are part of a rotor rotatably supported by a shaft co-axial with the rotor. The rotor is power-driven. The piston connecting rods rotate about a stud fixed to the casing and eccentric to the rotor. Each cylinder head includes a scoop rotating therewith and adapted to channel the gas or vapor into the cylinder head; and further includes a delivery pipe connected to a bore formed in the rotor supporting shaft which extends externally of one casing end wall. The cylinders and the pistons rotate in respective annular paths and yet the pistons make a reciprocating movement within their cylinders because of the eccentric mounting of the stud relative to the rotor axis.

3 Claims, 4 Drawing Figures

1
21
23
18
61
63
62
7
68
6
16'
18
17
16
27
25
16
16'
17
23
24
19
23
20
5
18'
22
33
35
18
34
2
16'
16'
62
62
3
21
3

RADIAL PISON PUMP

FIELD OF THE INVENTION

The present invention relates to a rotary fluid displacement machine of the cylinder and piston type.

BACKGROUND OF THE INVENTION

Conventional piston and cylinder machines can be relatively large and heavy, especially those designed to highly pressurize gases and vapors. Each piston must make a reciprocating movement and, therefore, the energy requirements are relatively large.

This invention is also related to applicant's previous U.S. Pat. No. 4,421,073, issued Dec. 20, 1983. In that patent, there is disclosed a rotary internal combustion engine wherein the cylinders are chambers in a rotor and the crankshaft is laterally offset from the axis of the rotor. In this way, the pistons are subjected to simple rotation. However, both the crankshaft and the rotor are rotating and must be synchronized.

It has been found possible to considerably simplify the mechanism of the above-noted patent.

OBJECTS OF THE INVENTION

In view of the above, it is an important object of the present invention to provide a machine of the type described in the above-noted patent in which the rotating crankshaft and associated gearing are eliminated.

It is another object of the present invention to provide a compressor of the above type, wherein each cylinder has an intake in the form of a scoop which precompresses the fluid.

It is another object of the invention to provide a compressor of the above type, wherein minimum work is needed to compress the fluid.

It is still another object of the invention to provide a fluid compressor of the above type which is simple in design.

SUMMARY OF THE INVENTION

The above and other objects and advantages of the present invention are realized according to a preferred embodiment comprising a casing having opposite end walls and supported on a base. A rotor is located within the casing and provided at one end with a rotor supporting shaft journalled in one end wall and extending outside the casing. The other end of the rotor is rotatably supported on a cylindrical boss fixed to the other end wall of the casing and coaxial with the rotor supporting shaft.

The rotor includes a plurality of radially-extending and equally-spaced cylinders in the general middle area of the casing. Thus, the cylinders are rotated by a first axis which is the axis of the boss and rotor supporting shaft.

Each cylinder has a piston movable therein which is rotatably connected to a stud by means of a connecting rod. The stud is fixed to the boss and has an axis parallel to and eccentric from said first axis by a distance equal to one-half the piston stroke. At piston dead-center positions, the connecting rods are aligned with the two axes. When the machine is a fluid compressor, the rotor may be driven either by the rotor supporting shaft or through gearing at the other end of the rotor.

All the cylinders are preferably identical and each is provided with a cylinder head having a novel inlet means.

The inlet means preferably consist of a scoop rigidly secured to the cylinder head and communicating with the interior of the latter. The scoops extend in the direction of rotation of the cylinders and are preferably outwardly flared to precompress gas or vapor entering therein. A gas intake in the casing allows the gas or vapor to pass freely into the casing.

When the machine is used as a compressor, the fluid delivery means may consist of a delivery pipe extending out of each cylinder head opposite the scoop side and communicating with the interior of the cylinder head and with one or more longitudinal bores in the rotor shaft. Thus, the compressed gas or vapor can pass through the rotor shaft to be collected externally of the casing.

BRIEF DESCRIPTION OF THE DRAWINGS

The above will be fully understood by having referral to the preferred embodiment of the invention, illustrated by way of the accompanying drawing, in which.

Like numerals indicate like elements throughout the drawings.

DETAILED DESCRIPTION OF THE PREFERRED EMBODIMENT

Figure 1:
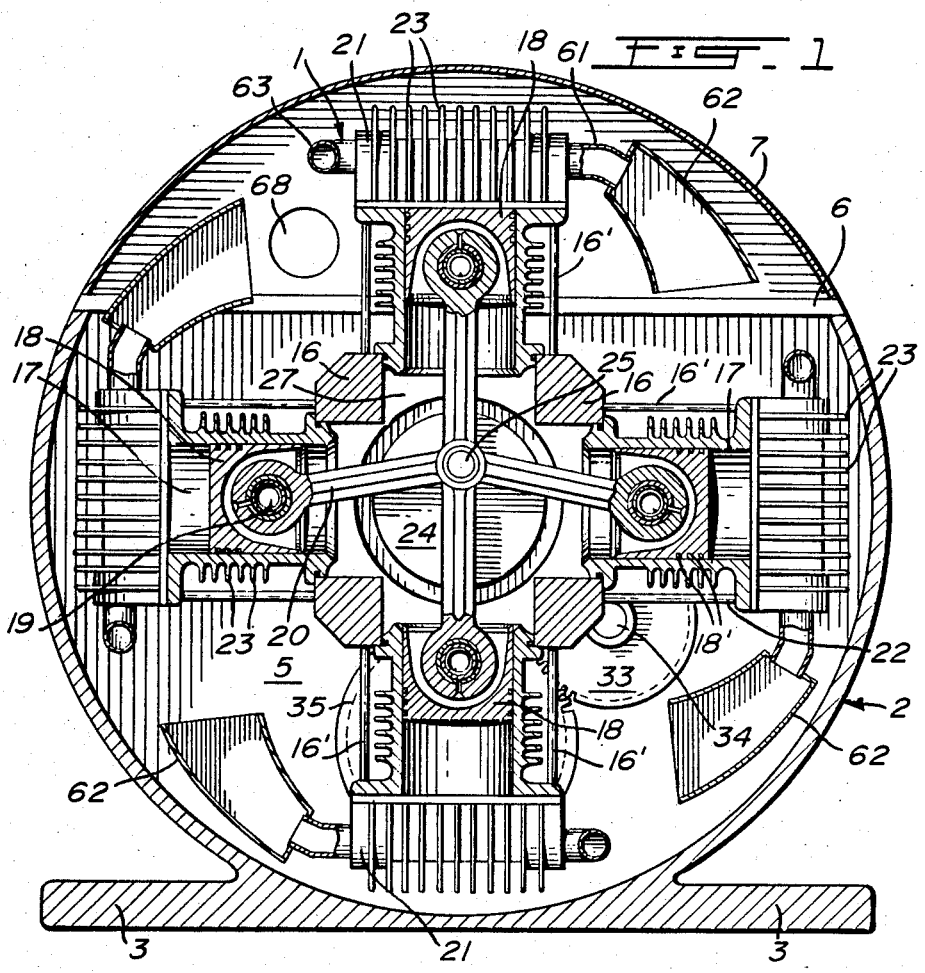
FIG. 1 is a vertically cross-sectioned end view of the machine according to the invention.

A compressor has a rotor 1 housed within a rigid casing 2 having a flat base 3. Casing 2 is of a cylindrical shape, having opposite end walls 4, 5 and is truncated at its upper portion 6, so that access may be had to the interior. A rigid cover 7 is secured to the upper portion 6 by bolts 8 to define a fully cylindrical unit.

Front wall 4 is preferably detachably secured to casing 2 by bolts 9.

A rotor supporting shaft 10 is rotatably journalled in wall 4 by a ball bearing 11 and is provided with a seal 12. Shaft 10 carries an exterior pulley 13, which is operatively connected by a belt 14 to a suitable power source, such as an electric motor.

The inner end of shaft 10 is integrally formed with or is secured to a square flat flange 15.

The latter has rigidly secured to its inner circumferential portion four regularly-spaced bars 16, orthogonal one to the other, which constitute part of the rotor 1 together with flange 15.

Each bar 16 rigidly supports by the tie rods 16' the lower end of a cylinder 17, as clearly shown in FIG. 1.

The four cylinders 17 which are part of rotor 1, are circular in cross-section and each central axis thereof corresponds to a radius of the axis of rotor shaft 10.

Mounted in each cylinder or piston chamber 17, is a piston 18 having piston rings 18', a transverse pivot pin 19 and a connecting rod 20 pivotally secured at one end to pivot pin 19. A cylinder head 21 is fitted and secured to the outer end of each cylinder 17 by bolts 21' and is described below. The four cylinders 17 and their respective cylinder heads 21 are formed with heat-dissipating fins 22, 23 respectively.

The opposite casing end wall 5 has an integral cylindrical, inwardly extending boss 24 from which frontwardly projects a single elongated stud 25 and fixedly secured thereto and to which are rotatively attached in side by side fashion the opposite ends of the four connecting rods 20. The axis of stud 29 is parallel to and is radially offset from the axis of the rotor shaft 10 a distance equal to half the piston strokes, so that relative reciprocative movement of the pistons 18 in their respective cylinders is effected despite the fact that each piston moves in a circular path. Boss 24 rotatably supports rotor 1 by means of a plate 27 fixed to bars 16 and needle bearings 28.

An annular gear 30 is secured to rotor bars 16 by screws 31 and serves also to secure plate 27 to bars 16. Annular gear 30 meshes with a driving gear 35 mounted on an auxiliary shaft 36, which is vertically downwardly spaced from stud 25.

Shaft 36 extends outwardly of casing 2, being journalled in wall 5 by a pair of spaced ball bearings 37 and provided with a seal 38. Shaft 36 is designed to be driven by, for instance, a Diesel engine, to drive rotor 1 as an alternative to pulley 13.

The gearing 30, 35 is located inside a compartment or sump 42 defined by end wall 5 and a partition 41, the sump filled with lubricating oil to level 43 for adequate lubrication of the gears. Lubricating passages 44 and 44' are formed in boss 24 and stud 25 and in bars 16 and gear 30, respectively, which passages communicate with the sump 42 for lubricating the cylinders and piston rod connections by movement of the gears in sump 42.

Figure 4:
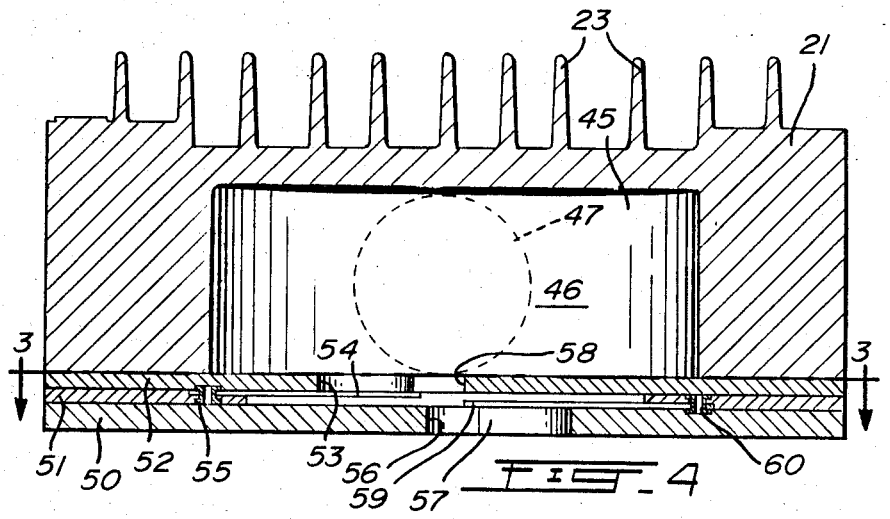
FIG. 4 is a cross-sectional view of a cylinder head taken along line 4—4 of FIG. 3.
Figure 3:
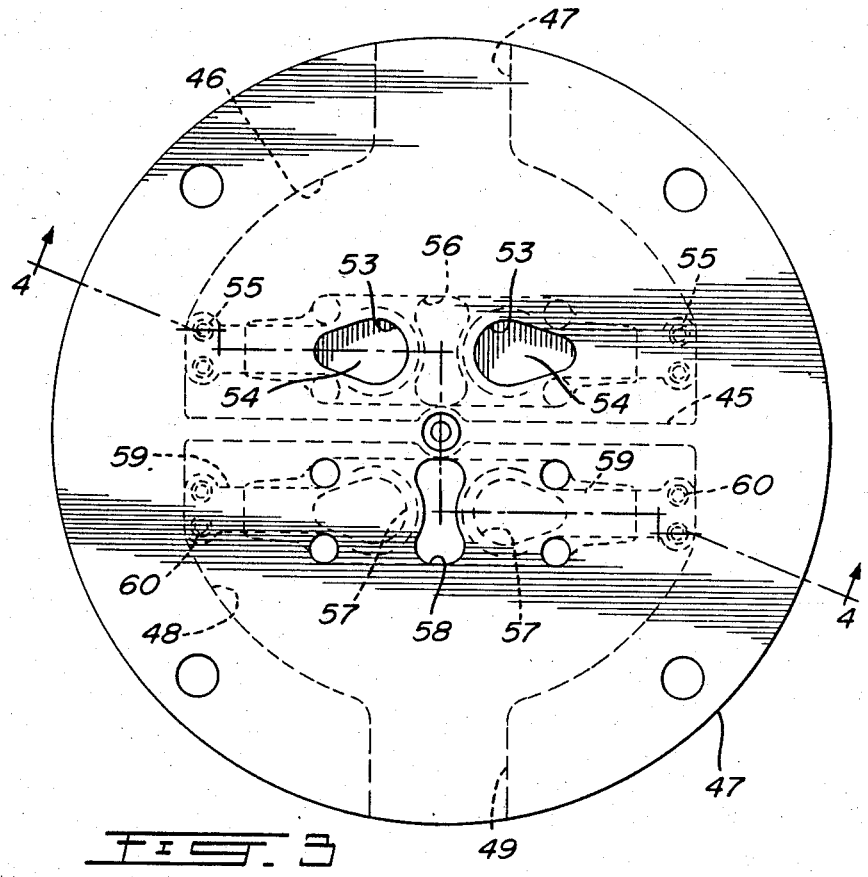
FIG. 3 is a top plan view of one of the cylinder head valve plates, taken along line 3—3 of FIG. 4.

Referring to FIGS. 3 and 4, there is shown a cylinder head 21 of conventional construction for a compressor and including a partition 45 which defines an intake chamber 46 having an inlet 47, and a delivery chamber 48 having an outlet 49. An assembly of an inner valve plate 50, an intermediate plate 51 and an outer valve, plate 52 is sandwiched between head 21 and the outer end of cylinder 17. In outer valve plate 52 are formed a pair of intake openings 53, of generally pear-shape profile, which directly communicate with intake chamber 46. Openings 53 are underlaid by leaf springs 54 secured at their remote ends by rivets 55 to intermediate plate 51. The fluid is admitted to cylinder 17 through an opening 56 of inner plate 50. Similarly, inner valve plate 50 is formed with a pair of delivery openings 57, of the same shape as openings 53, which communicate with delivery chamber 48, through an opening 58 of outer plate 52. Openings 57 are releasably closed by leaf springs 59, which overlie their respective delivery opening 57 and are secured by rivets 60 at their remote ends. The above check valve arrangement is of known construction. Gas or vapor is drawn in to intake chamber 46, compressed and delivered to delivery chamber 48 in known manner.

As shown in FIG. 1, into the inlet 47 of intake chamber 46, is screwed an intake pipe 61 which is formed at its outer end with an intake scoop 62 which is flared towards its opened extremity. Scoop 62 serves to precompress the gas or vapor entering intake chamber 46 as each cylinder rotates.

The outlet 49 at the opposite side of each cylinder head 21 is of smaller diameter than the inlet 47. An elbow pipe 63 is screwed into outlet 49 and carries a nut 64 at its outer end for sealingly connecting one end of a second longer elbow pipe 65, the other end of which is sealingly connected to the circumferential edge of rotor flange 15. The latter is formed with four radial conduits 66, each communicating with an elbow pipe 65 and also with a central longitudinal bore 67 extending in shaft 10. Obviously, each conduit 66 could communicate with a separate bore 67. Thus the compressed gas passes out through shaft 10 as the cylinders rotate inside casing 2 to be delivered tb a storage tank through a rotary coupling connected to the outer end of shaft 10. Gas intakes 68 are provided in the end walls of cover 7 for admission of gas or vapor into casing 2, preferably through air filters 69.

Figure 2:
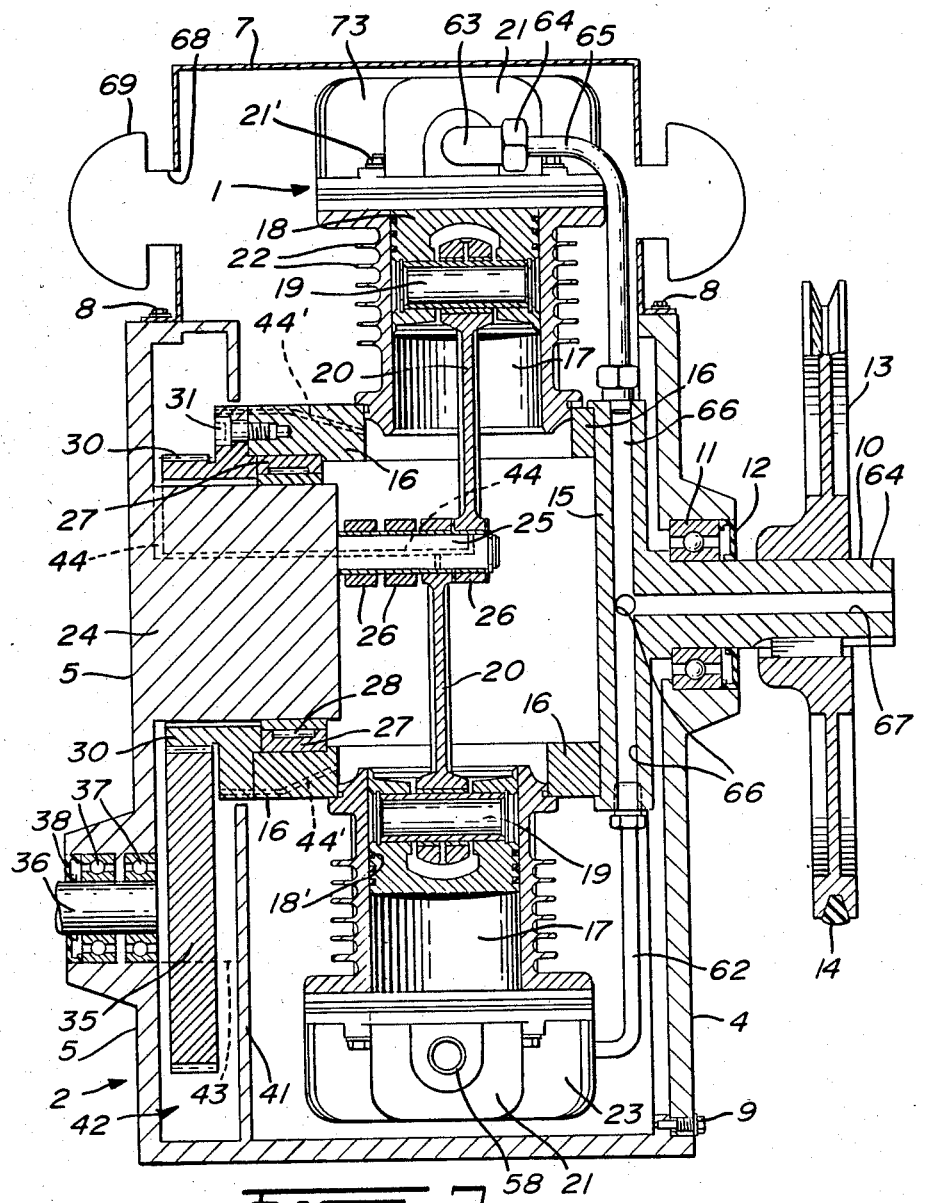
FIG. 2 is a longitudinal section of the same.

FIG. 2 clearly illustrates how cylinders 17 are offset relative to each other axially of shaft 10 so that each connecting rod 20 remains centered in the rotational plane of its cylinder 17 despite the side by side connection of the piston rods to stud 25.

Of course, the present device could be used, with proper modifications, as a fluid motor or as a combustion engine, wherein shafts 36 or 10 become the torque shaft.

What we claim is:

1. A radial piston pump type air compressor comprising a casing having casing end walls, a rotor located within said casing and having one and another end, a rotor supporting shaft fixed to said rotor one end and journalled in one of said casing end walls, a boss fixed to the other casing end wall and rotatably supporting said rotor other end, said boss being cylindrical and defining a first axis co-axial with said rotor supporting shaft, said rotor including a plurality of radially-extending and equally-spaced cylinders offset one with respect to the other axially of said supporting shaft and each defining an outer end closed by a cylinder head; said cylinders rotatable about said first axis; a cylindrical stud projecting from said boss in said casing and disposed along a second axis which is parallel to and eccentric from said first axis, a piston movable in each cylinder, a connecting rod pivotally connected to said piston at one end and to said cylindrical stud at its other end; said connecting rods pivotally mounted on said studs in side-by-side relation and each disposed in the central rotational plane of the associated cylinder; and intake check valve and a delivery check valve mounted in each cylinder head, an atmospheric air intake associated wiht said intake check valve, said air intake forming a scoop extending within the casing in the direction of rotation of its associated cylinder and flaring in said direction, said casing having openings for the admission therein of atmospheric air to be compressed and to be collected by said scoop, and compressed air conduits connected to said delivery check valve, extending within said rotor supporting shaft, and opening at the exterior of said casing, for the delivery of compressed air from said cylinders.

2. The pump of claim 1, further including means on said rotor supporting shaft for connecting the latter to a first driving means, an annular gear fixed to said rotor around said boss, and auxillalry shaft journalled in said casing, a gear keyed to sid auxiliary shaft within said casing and meshing with said annular gear, said auxiliary shaft adapted to be driven by a second driving means.

3. A pump as claimed in claim 2, further including a partition within said casing for enclosing said gears and adapted to contain lubricating oil, said gears circulating said lubricating oil through oil passages in said boss and in said stud for the lubrication of the pivotal connections of said connecting rods to said stud.

* * * * *